United States Patent [19]

Merz et al.

[11] Patent Number: 4,941,966

[45] **Date of Patent: * Jul. 17, 1990**

[54] PROCESS FOR THE HYDROGENATIVE CONVERSION OF HEAVY OILS AND RESIDUAL OILS

[75] Inventors: Ludwig Merz, Recklinghausen; Klaus Niemann, Oberhausen, both of Fed. Rep. of Germany

[73] Assignee: Veba Oel Entwicklungs-Gesellschaft mbH, Gelsenkirchen, Fed. Rep. of Germany

[ * ] Notice: The portion of the term of this patent subsequent to Jul. 25, 2006 has been disclaimed.

[21] Appl. No.: 172,225

[22] Filed: Mar. 23, 1988

[30] Foreign Application Priority Data

Mar. 30, 1987 [DE] Fed. Rep. of Germany ..... 3710021

[51] Int. Cl.[5] ..... C10G 49/02

[52] U.S. Cl. ..... 208/112; 208/144; 208/180; 208/400; 208/434; 585/240; 585/241

[58] Field of Search ..... 208/112, 144, 179, 180, 208/262.1, 262.5, 400, 434; 585/240, 241, 250

[56] References Cited

U.S. PATENT DOCUMENTS

| | | | |
|---|---|---|---|
| 3,704,108 | 11/1972 | Alpert | 585/241 |
| 4,089,773 | 5/1978 | Espenscheld | 582/241 |
| 4,152,244 | 5/1979 | Raichle et al. | 208/414 |
| 4,251,500 | 2/1981 | Morita et al. | 585/241 |
| 4,370,221 | 1/1983 | Patmore et al. | 208/112 |
| 4,435,280 | 3/1984 | Ranganathan et al. | 208/112 |
| 4,448,665 | 5/1984 | Zaczepinski | 208/112 |
| 4,623,448 | 11/1986 | O'Connel et al. | 208/262.5 |
| 4,642,401 | 2/1987 | Coenen et al. | 585/241 |

*Primary Examiner*—Anthony MacFarlane

*Attorney, Agent, or Firm*—Oblon, Spivak, McClelland, Maier & Neustadt

[57] ABSTRACT

A process for the hydrogenative conversion of mixtures of oil and organic waste products, comprising the steps of:

(i) preparing a hydrogenation mixture comprising
  (a) a heavy oil, residual oil, or mixtures thereof, or
  (b) a used oil, a waste oil or mixtures thereof, or mixtures of (a) and (b), and
  (c) one or more organic waste products containing natural or synthetic organic compounds comprising uncrosslinked or crosslinked carbon chains;

(ii) contacting said hydrogenation mixture with 0.1–10 wt. % of an additive selected from the group consisting of high surface area suspended solids containing carbon, red mud, iron oxides, electrostatic filter dusts and cyclone dusts, wherein said additive comprises particles in two different particle size ranges, a fine particle fraction with a particle size 90 microns or less, and a coarse particle fraction with a particle size between 100–1000 microns; and (iii) hydrogenating said contacted mixture at a hydrogen partial pressure of 50–350 bar, a temperature of 250°–500° C. and a gas/oil ratio of 100 to 10,000 $m^3/t$ of said hydrogenation mixture calculated at (STP), wherein the weight ratio (a)/(b), (a)/(c), or (a) to (b)+(c) is in the range of 100:1 to 1:15.

18 Claims, No Drawings

PROCESS FOR THE HYDROGENATIVE CONVERSION OF HEAVY OILS AND RESIDUAL OILS

BACKGROUND OF THE INVENTION

1. Field of the Invention

The present invention is directed to a process for the hydrogenation of mixtures of oils, coal and organic waste products.

2. Discussion of the Background

U.S. application Ser. No. 07/105,290, filed Oct. 7, 1987 discloses a process for the conversion by hydrogenation of heavy oils and residual oils, used oils and waste oils, and optionally mixtures of these oils with ground lignite and anthracite coals in the liquid phase or combined liquid and gas phases with gases containing hydrogen. The process is operated at a hydrogen partial pressure of 50 to 300 bar, preferably 150 to 200 bar, at a temperature of 250° to 500° C., preferably 400° to 490° C., and with a gas/oil ratio of 100 to 10,000 $m^3/t$, preferably 1000 to 5000 $m^3/t$ of the liquid and solid starting materials with the addition of at least one additive in quantities of 0.5 to 5.0 wt. % based on the total amount of liquid and solid starting materials, wherein the additive is added in two different particle size ranges to increase the specific throughput.

A process for the processing of wastes and biomasses containing carbon by hydrogenating them at elevated temperature at a hydrogen pressure of at least 1 bar is described in European patent application No. 0 182 309 A1.

In the hydrogenative conversion of heavy oils and residual oils, used oils and waste oils, especially when mixed with organic or synthetic substances such as wastes and biomasses, that have to be finely dispersed before they are fed to the liquid phase hydrogenation, it is found that there are difficulties in achieving adequate filling of the liquid phase reactors, as manifested in the observed pressure drop across the reactor height.

SUMMARY OF THE INVENTION

Accordingly, one object of the present invention is to provide a process for adding wastes and/or biomasses to heavy oil or residual oil based on petroleum and to produce synthetic crude oil by hydrogenation of this mixture.

Another object of the invention is to provide a process in which the wastes and biomasses are added to residual or heavy oil and additionally mixed with finely ground coal and hydrogenated to produce synthetic crude oil.

These and other objects which will become apparent from the following specification have been achieved by the present process for the hydrogenative conversion of mixtures of oils and organic waste products which comprises the steps of (i) preparing a hydrogenation mixture comprising:
  (a) a heavy oil, a residual oil, or mixtures thereof,
  (b) a used oil or a waste oil, or mixtures thereof, or mixtures of (a) and (b), and
  (c) one or more organic waste products containing natural or synthetic organic compounds comprising uncrosslinked or crosslinked carbon chains;

(ii) contacting this mixture with 0.1–10 wt. % based on the hydrogenation mixture, of an additive selected from the group consisting of high surface area suspended solids containing carbon, red mud, iron oxides, electrostatic filter dusts and cyclone dusts, wherein the additive comprises particles in two different particle size ranges, a fine particle fraction with a particle size 90 microns or less, and a coarse particle fraction with a particle size between about 100–1000 microns, and (iii) hydrogenating this mixture at a hydrogen pressure of 50–350 bar, a temperature of 250°–500° C. and at a gas/oil ratio of 100 to 10,000 $m^3/t$-h of the hydrogenation mixture calculated at standard temperature and pressure (STP), wherein the weight ratio of (a)/(b), (a)/(c), or (a) to (b)+(c) is in the range of 100:1 to 1:15.

DETAILED DESCRIPTION OF THE PREFERRED EMBODIMENTS

The objects of the present invention are achieved by adding waste oils or waste materials to the starting materials for the hydrogenation of residual oil or heavy oil based on petroleum, optionally mixed with finely ground coal, to produce a synthetic crude oil by hydrogenation, whose properties are determined essentially by the products from the residual oil. This avoids the obvious problems associated with the disposal of the aforementioned waste oils or waste materials in dumps or by thermal combustion processes.

The components can also be used beneficially in the ratio by weight of (a)+(b) to (c) of 100:1 to 1:1.5.

In particular, the organic waste products which may be added to the hydrogenation mixture include sewage sludges from presettling tanks, biological clarification, digestion towers, paint sludges, halogen-containing solvents or their distillation residues, recycling process solvents, used oils containing PCB's or halogens and that may also can contain solids, transformer oils, hydraulic oils, organic residues from chemical cleaning plants, organic residues from the degreasing of parts or cleaning baths, dump drainage oils, bilge oils, tank cleaning residues, plastics or used plastics or wastes from plastics production. These organic waste products can be subjected to pressurized hydrogenation under the typical conditions of liquid phase hydrogenation in a cascade of liquid phase hydrogenation reactors or in a single hydrogenation reactor followed by one or more hot separators or combined liquid phase-gas phase hydrogenation.

The present process for mixing waste oils or waste materials, i.e., organic or synthetic substances having uncrosslinked or crosslinked carbon chains to the feedstock of hydrogenation systems consisting, for example, of residual oil, heavy oil, or vacuum residue, or mixing them as a side stream into the hydrogenation reactor, has the following benefits.

The heat of hydrogenation that is produced during the conversion of heavy oils is utilized to convert and decontaminate the waste oils or waste materials under the conditions of liquid phase hydrogenation. Only a small heat of reaction is expected in the hydrogenation of such waste oils or waste materials alone. This significantly reduces the energy requirements of the preheater system of a typical system for liquid phase hydrogenation of these waste materials.

The bubble column maintained during operation in the hydrogenation reactors is also suitable for processing waste oils containing solids by utilizing the stable fluid dynamics of the mixture of residual oil or heavy oil based on petroleum with the hydrogenation gas as the "carrier" component. The heavy oils and residual oils preferably have a flow rate from about 0.1–2 t/m$^3$ per hour.

When the waste oils or waste materials are added to the petroleum residual oil, a synthetic crude oil is formed in the hydrogenation system that can be processed further in existing refinery operations.

It is possible by the present process to dispose of waste oils or waste materials that are classified as special wastes in such a way that the carbonaceous components contained in these materials, especially including hydrocarbon chains, are retained.

At the same time, there is extensive elimination of heteroatoms, especially oxygen, sulfur, nitrogen and halogens by conversion into the corresponding hydrogen compounds, passage into the gas phase, and their discharge with the waste water in which the hydrogen halides as well as ammonia and hydrogen sulfide are partially or completely dissolved.

The contents of heavy metals or ash-forming constituents in the starting materials are effectively transferred into the residue in the hot separator systems following the liquid phase hydrogenation. Depending on the type of starting materials, this involves variable quantities; for example, elevated amounts of ash-formers and heavy metals have to be discharged through the residue in the case of waste materials comprising used oils or sewage sludges containing solids.

In a preferred embodiment, the above-mentioned starting materials that form the starting materials (a), (b) and (c) noted above are also combined with ground coal in a ratio by weight of 20:1 to 1:1.5, preferably 5:1 to 5:4.

When using an additive in the form of a high surface area suspended solid containing carbon in liquid phase hydrogenation the additive is preferably added in amounts of 0.1 to 10, more preferably 0.5 to 5.0 wt. %. It is preferred to use lignite cokes from blast furnaces and hearth furnaces, carbon blacks from the gasification of heavy oil, anthracite, hydrogenation residues, or lignite, and the activated cokes produced from them, petroleum coke, and dusts from the Winkler gasification of coal.

The carbonaceous additives used are preferably impregnated with solutions of metal salts. Metals of the 1st to 8th subgroups and of the 4th main group of the Period Table of Elements may be used, preferably iron, cobalt, nickel, vanadium, or molybdenum.

It is also preferred to use as the additive, 0.1 to 10 wt. %, preferably 0.5 to 5.0 wt. % of red mud, iron oxides, electrostatic filter dusts, and cyclone dusts from the processing of metal or ore. These compositions can be used as such or after pretreatment, for example sulfurization and the like.

The addition of high surface area additives containing carbon in liquid phase hydrogenation also favors reactions of hydrodemetallization and hydrodesulfurization. This leads to removal of the constituents containing metal or ash-forming constituents with the hot separator residue. These constituents in this form undergo transformation into a state that is easier to handle than in the starting material. In addition, the metal and ash-forming constituents are concentrated in the hot separator residue to such an extent that they can also be recovered by metallurgical procedures for example.

It is preferred to use the additive in two fractions with a sharply separated particle size spectrum, but the additive can also be used with a continuous particle size distribution with the corresponding large or coarse particle size fraction having an average particle size of 100 μm or larger.

Preferably, the additive is added in two different particle size fractions, i.e., a fine particle fraction having a particle size of 90 μm or less, preferably 50 μm or less and a coarse particle or large particle fraction having a particle size in the range of 100–2,000 μm, preferably 100–1,000 μm, most preferably 100–500 μm. The two separate particle size fractions may be added separately or may be premixed and subsequently added to the hydrogenation mixture. A preferred embodiment of the use of two different particle size fractions in the hydrogenation process of the present invention is disclosed in U.S. application Ser. No. 07/105,290 filed Oct. 7, 1987. The disclosure of this application is incorporated herein by reference for a more complete description of the additive, relative amounts of fine to coarse particle fractions and the hydrogenation process.

In the preferred embodiment noted above, a mixture of two different particle size fractions is used such that the mixture of fractions cannot be represented by a straight line when its accumulative weight versus particle size, which is plotted on log (−log) versus log graph paper has a correlation coefficient less than 0.96 as determined from the equation:

$$R^2 = \frac{[n\Sigma xy - (\Sigma x)(\Sigma y)]^2}{[n\Sigma x^2 - (\Sigma x)^2][n\Sigma y^2 - (\Sigma y)^2]}$$

wherein n is the number of experimental points, y is ln [−ln(η/100)] and x is ln(dp) where % η is the accumulative weight under a dp in wt. % and dp is particle size in microns. See Edwin L. Crow, Statistics Manual, page 164.

In the hydrogenation of mixtures of heavy oils or residual oils, used oils or waste oils with sewage sludges, the ratio by weight of oil to sewage sludge is preferably from 10:1 to 1:15. A sewage sludge can be used that contains a corresponding fraction of coarse particles 100 μm or larger in size. The sewage sludge can completely or partly replace the additive.

The fraction of coarse particles used can amount to 20 wt. % or more of the additive used, and may include the carbonaceous, high surface area suspended solids, and the aforementioned red compounds, iron oxides, electrostatic filter dust, and cyclone dusts.

During the operating phase of the present hydrogenation process, the concentration of the coarse particle fraction of the additive increases. Accordingly, the fraction of coarse particles in the additive may be less than 20 wt. % so long as the total proportion of coarse particles in the hydrogenation mixture amounts to 20 wt. % or more. In other words, the coarse particles originating in the waste materials may substitute for a portion of the coarse particle fraction of the additive so long as the overall coarse particle fraction is 20 wt. % or more of the additive used.

In the hydrogenative conversion of mixtures of heavy oils or residual oils, used oils or waste oils, mixed with the other starting materials mentioned above, i.e., the organic waste products, and in the presence of lignite or anthracite coal in the so-called "coprocessing mode" of operation, ratios by weight of oil to coal of 5:1 to 1:1.5 are preferred. A portion of the coal with particle sizes of 100 μm or larger can be used, corresponding to the proportion of the coarse particle size fraction of the additive to be added.

When the waste oils or waste materials contain halogen constituents, hydrogen halides are formed during the hydrogenation process. Neutralizing agents may be added to the hydrogenation mixture to neutralize the hydrogen halides formed. While any neutralizing agent which can effectively react with hydrogen halides may be used, preferred neutralizing agents are alkali and alkaline earth sulfides and hydroxides. A particularly preferred neutralizing agent is sodium sulfide. The neutralizing agent may be added as a solid, as an aqueous solution or as a suspension in oil, preferably in amounts of 0.01–5.0 wt. %. A particularly preferred embodiment is the addition of sodium sulfide in aqueous solution.

The neutralizing compounds are preferably injected together with water at a suitable point in the discharge flow of the liquid phase reactor, and can be discharged from the process as an aqueous solution of the corresponding halides, for example by phase separation, in the so-called cold separators.

A preferred embodiment of the present process is the addition of sewage sludge as the organic waste product. The sludge is preferably dried to a water content of less than 10.0 wt. %, preferably less than 2.0 wt. %, and if necessary, it is freed of large extraneous objects by grinding, screening or sifting, and is brought to a particle size of less than 1.0 mm, preferably less than 0.5 mm. The sewage sludge treated in this way can partly or completely replace the additive described above. The type and quantity of expendable additive is selected on the basis of the desired conversion rate and tendency of the starting material to form coke.

The present process for the hydrogenative conversion of heavy oils and residual oils, mixed with municipal or industrial sewage sludges in the liquid phase or combined liquid and gas phases is preferably carried out in such a way that a high-pressure pump delivers the oil or the oil/solids mixture including the additive into the high-pressure section of the system. Circulating gas containing recycle hydrogen and fresh hydrogen are heated, and for example, mixed with the residual oil in the high-pressure section. To utilize the heat of reaction of the process, the reaction mixture flows through a heat exchanger and a preheater and then arrives at the liquid phase reactors. The reactor system may consist, for example, of three vertical empty tube reactors that are filled from the bottom, giving direction of flow from bottom to top. The conversion occurs in the reactors at temperatures between about 250°–500° C., preferably between about 400° C. to about 490° C. and with a hydrogen partial pressure of 50 to 350 bar, preferably 150–200 bar. A quasi-isothermal mode of operation of the reactors is possible by injection of cold hydrogen gas.

The unconverted fraction of the heavy oils and residual oils used and the solids are separated from the gaseous reaction products under process conditions in hot separators which follow the hydrogenation reactors and which are operated at approximately the same temperature as the reactors. The liquid product from the hot separator is depressurized in a multistage flash unit. In the case of combined operation in liquid and gas phases, the head product of the hot separators, the flash distillates, and any crude oil distillate fractions to be coprocessed are combined and fed to the following gas phase reactors. Hydrotreating or gentle hydrocracking may also take place on a catalytic fixed bed reactor preferably under the same total pressure as in the liquid phase, for example, under so-called trickle flow conditions. After intensive cooling and condensation, the gas and liquid are separated in a high-pressure cold separator. After phase separation, the waste water can be discharged from the process at this point. The liquid product is depressurized and processed further in conventional refinery processes.

The gaseous reaction products ($C_1$ to $C_4$ gases, $H_2S$, $NH_3$, hydrogen halides) are concentrated in the process gas, with the water-soluble constituents being discharged with the waste water and the $C_1$ to $C_4$ gases are separated according to their solubility, preferably by an oil wash. The hydrogen remaining in the process gas is recycled as circuit gas with small amounts of inert gases and other gaseous components.

Other features of the invention will be come apparent in the course of the following descriptions of exemplary embodiments which are given for illustration of the invention and are not intended to be limiting thereof.

EXAMPLES

EXAMPLE 1

In a hydrogenation system operated continuously with three successive vertical liquid phase reactors without internals, the vacuum residue of a Venezuelan heavy oil, with the addition of 2.0 wt. % of lignite coke with an upper particle size limit of 40 μm, and with the admixture of 10% sewage sludge (dried to less than 2.0% residual moisture, ground, and screened to smaller than 150 μm), was converted with 1.5 $m^3$ of $H_2$ per kg of residue and with a hydrogen partial pressure of 190 bar. To produce a residue conversion rate of 90%, an average temperature of 465° C. was set across the successive liquid phase reactors. The specific throughput was 0.54 kg/1×h (500° C.+).

The results are summarized in the table below.

TABLE 1

| | |
|---|---|
| Operating conditions | |
| LPH temperature | 465° C. |
| Specific throughput | 0.54 t/$m^3$h of oil with a boiling range of 500° C.+ |
| Additive used | 2.0 wt. % based on oil used |
| Sewage sludge used | 10.0 wt. % based on oil used |
| Yield | |
| Conversion 500° C.+ oil | 90.2% |
| $C_1$–$C_4$ gases | 7.6% |
| Sewage sludge conversion (organic fraction) | greater than 70% |

EXAMPLE 2

In a continuously working hydrogenation installation with a liquid phase reactor without inserts, a vacuum residue of Near-East crude oil was converted together with 15% by weight of a used industrial cleaning solution with a chlorine content of 4% by weight and 15% by weight of sewage sludge (dried to less than 2% residue moisture) with 1.5 $m^3$ $H_2$ per kg residue at 210 bar hydrogen partial pressure. The sewage sludge was ground up in such a manner that 90% of the material were in a grain spectrum below 90 microns and 10% between 100 and 150 microns. For neutralizing the HCl produced, 1% by weight $Na_2S$ relative to the residue was continuously added. At 465° C. in the liquid phase reactor, the vacuum residue was converted to 91% by weight into lower boiling products. These products contained less than 1% by weight ppm chlorine, the organic portion of the sewage sludge had been converted into liquid product at more than 75% by weight. A hydrocarbon gas formation ($C_1$–$C_4$) of 8.1% by weight relative to the residue used was observed.

EXAMPLE 3

In a continuously operating hydrogenation installation with a combined liquid/gaseous phase hydrogenation a Venezuelan vacuum residue was converted together with 30% by weight (relative to the vacuum residue) of a used metal degreasing solution. The aromatic and phenol containing degreasing solution had a chlorine content of 1.02% by weight and contents of oxygen of 3.7% by weight, nitrogen 0.92% by weight, sulphur 0.98% by weight, the content of the 0°–200° C. boiling fraction was 44% by weight, the content of the 200°–350° C. fraction was 22% by weight. The conversion in the liquid phase hydrogenation occurs with the addition of 2% by weight of a soft coal coke as additive with grain sizes of 1.5% by weight smaller than 90 microns and 0.5% by weight between 100 and 400 microns at a specific flow rate of 0.5 kg/l.h (relative to vacuum residue), an $H_2$/oil ratio of 2000 $nm^3/t$ and a hydrogen partial pressure of 200 bar. At 465° C. the used vacuum residue was converted to lower boiling products (less than 500° C.) at 90% by weight. The primary product of the liquid phase hydrogenation had a chlorine content of less than 1% by weight ppm. With the addition of double the stoichiometric amount of sodium sulfide the chlorine contained in the metal degreasing solution was separated as sodium chloride by means of a hot separator solid. The primary product of the liquid phase hydrogenation was subjected, in a directly coupled gaseous phase hydrogenation, at 380° C. and a catalyst charge of 2.0 kg/kg.h, to catalytic fixed bed refining on a commercial refining bed. The produced complete product, after gaseous phase hydrogenation, was free of phenol and of chlorine, the content of sulphur and nitrogen was less than 0.1% by weight.

EXAMPLE 4

In a continuously operating hydrogenation installation with a liquid phase reactor without insert, a Venezuelan vacuum residue, together with 10% by weight of a distillation residue from a solvent recycling (dried at 100° C. in vacuum, ground and sifted to less than 150 micron, of which 75% by weight have a particle size of less than 90 microns and 25% by weight a particle size of 100 to 150 microns was converted at a specific flow rate of 0.5 kg residue/l.h, a $H_2$/oil ratio of 3000 $nm^3/t$ and a hydrogen partial pressure of 200 bar. At 456° C. the vacuum residue used was converted to 94% by weight into lower boiling products. The organic portion of the distillation residue (ash content: 17% by weight, carbon content: 54% by weight, hydrogen content: 6.5% by weight, sulphur content: 0.2% by weight, residue: nitrogen and oxygen) was converted to more than 80% by weight into liquid products and gases.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for the hydrogenative conversion of mixtures of oil and organic waste products, comprising the steps of:

(i) preparing a hydrogenation mixture comprising
  (a) a heavy oil,
  (b) a used oil or a waste oil, and
  (c) one or more organic waste products different than (b) containing natural or synthetic organic compounds comprising uncrosslinked or crosslinked carbon chains;

(ii) contacting said hydrogenation mixture with 0.1–10 wt. % based on said hydrogenation mixture of an additive selected from the group consisting of carbon, red mud, iron oxides, electrostatic filter dusts and cyclone dusts, wherein said additive comprises a mixture of particles in two different particle size ranges, a fine particle fraction with a particle size 90 microns or less, and a coarse particle fraction with a particle size between 100–1000 microns, said mixture of fractions having a correlation coefficient $R^2$ less than 0.96 as determined from the equation:

$$R^2 = \frac{[n\Sigma xy - (\Sigma x)(\Sigma y)]^2}{[n\Sigma x^2 - (\Sigma x)^2][n\Sigma y^2 - (\Sigma y)^2]}$$

wherein n is the number of experimental points, y is ln [−ln ($\eta$/100)], x is ln (dp), dp is particle size in microns, and % $\eta$ is the accumulative weight under a dp in wt. %; and (iii) hydrogenating said contacted mixture at a hydrogen partial pressure of 50–350 bar, a temperature of 250°–500° C. and a gas/oil ratio of 100–10,000 $m^3/t$ of said hydrogenation mixture calculated at standard temperature and pressure wherein the weight ratio (a)/(b), (a)/(c), or (a) to (b)+(c) is in the range of 100:1 to 1:15.

2. The process of claim 1, wherein the weight ratio (a)+(b) to (c) is in the range 100:1 to 1:1.5.

3. The process of claim 1, wherein said organic waste product is selected from the group consisting of sewage sludge from presettling tanks, biological clarification, digestion towers, paint sludges, halogen-containing solvents or their distillation residues, recycling process solvents, used oils containing PCB's or halogens, transformer oils, hydraulic oils, organic residues from chemical cleaning plants, organic residues from degreasing of parts or cleaning baths, dump drainage oils, bilge oils, tank cleaning residues, plastics or used plastics, and wastes from plastics production.

4. The process of claim 1, further comprising adding ground coal to said hydrogenation mixture, wherein the ratio by weight of said coal to the sum of components (a), (b) and (c) is from 1:20 to 1.5:1.

5. The process of claim 4, wherein the ratio by weight is 1:5 to 4:5.

6. The process of claim 1, wherein said additive is a suspended solid containing carbon used in an amount from 0.5–5.0 wt. %.

7. The process of claim 1, wherein said hydrogen partial pressure is 150–200 bar.

8. The process of claim 1, wherein said temperature is 400°–490° C.

9. The process of claim 1, wherein said coarse particle fraction comprises particles having a particle size in the range 100–500 μm.

10. The process of claim 6, wherein said carbon is selected from the group consisting of lignite coke, carbon black from gasification of heavy oil, anthracite, hydrogenation residues, lignite, activated coke, petroleum coke, and dusts from Winkler gasification of coal.

11. The process of claim 1, wherein said carbon is impregnated with a metal salt solution, wherein said metal comprises a metal taken from groups 1b, 2b, 3b, 4b, 5b, 6b, 7b, 8 and 4a of the Periodic Table.

12. The process of claim 11, wherein said metal is selected from the group consisting of iron, cobalt, nickel, vanadium and molybdenum.

13. The process of claim 1, wherein said additive comprises 0.5–5 wt. % of red mud, iron oxides, electrostatic filter dusts, and cyclone dusts from metal or ore processing.

14. The process of claim 1, wherein said coarse particle fraction comprises 20 wt. % or more of said additive.

15. The process of claim 1, further comprising adding 0.01–5.0 wt. % of a neutralizing agent to said hydrogenation mixture.

16. The process of claim 15, wherein said neutralizing agent is a metal hydroxide or sulfide selected from the group consisting of alkali and alkaline earth metals and mixtures thereof.

17. The process of claim 15, wherein said neutralizing agent is sodium sulfide.

18. The process of claim 15, wherein said neutralizing agent is added as an aqueous solution.

* * * * *